US007775565B2

(12) United States Patent
Hartmann et al.

(10) Patent No.: US 7,775,565 B2
(45) Date of Patent: Aug. 17, 2010

(54) CLOSING MECHANISM FOR A HOUSEHOLD APPLIANCE

(75) Inventors: Michael Hartmann, Höchstädt (DE); Dieter Hotz, Dischingen-Eglingen (DE); Cengiz Kuecuek, Syrgenstein (DE); Heinrich Mueller, Tuttlingen (DE); Axel Rastemborski, Spaichingen (DE); Bernd Schessl, Dillingen/Donau (DE); Erich Schmid, Sontheim/Brenz (DE); Martin Stickel, Giengen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 11/873,035

(22) Filed: Oct. 16, 2007

(65) Prior Publication Data

US 2008/0185849 A1 Aug. 7, 2008

Related U.S. Application Data

(63) Continuation of application No. PCT/EP2006/061579, filed on Apr. 13, 2006.

(30) Foreign Application Priority Data

Apr. 19, 2005 (DE) ..... 10 2005 017 871

(51) Int. Cl.
*E05C 5/02* (2006.01)
*E05B 63/20* (2006.01)

(52) U.S. Cl. ..... 292/60; 292/216; 292/335; 292/DIG. 4; 292/DIG. 11; 292/DIG. 69

(58) Field of Classification Search ..... 292/60, 292/335, DIG. 4, DIG. 11, DIG. 69
See application file for complete search history.

(56) References Cited

U.S. PATENT DOCUMENTS

| | | | | | |
|---|---|---|---|---|---|
| 1,372,000 | A | * | 3/1921 | Anderson | 292/216 |
| 1,411,059 | A | * | 3/1922 | Moore | 292/335 |
| 1,662,450 | A | * | 3/1928 | Anderson | 292/335 |
| 2,145,112 | A | * | 1/1939 | Fedor, Jr. | 292/335 |
| 3,260,813 | A | * | 7/1966 | Dargene | 200/61.64 |
| 5,090,751 | A | * | 2/1992 | Kobayashi | 292/71 |

(Continued)

FOREIGN PATENT DOCUMENTS

| | | | |
|---|---|---|---|
| EP | 0 727 178 | A2 | 8/1996 |
| EP | 0 917 853 | A1 | 5/1999 |
| GB | 2 133 455 | A1 | 7/1984 |
| JP | 58-146680 | A1 | 9/1983 |

*Primary Examiner*—Carlos Lugo
(74) *Attorney, Agent, or Firm*—Burr & Brown

(57) ABSTRACT

A closing mechanism for a movable closing element, preferably for a door, a cover or a flap on a household appliance, such as a dishwasher, a washing machine, or a refrigerator, the mechanism comprises a carriage that can be displaced between a locking position and an unlocking position and is loaded by a spring force in the direction of the locking position. The carriage carries a closing hook that can be engaged with the closing element for the closing action and/or disengaged therefrom for the opening action. A rotary latch cooperates with the closing element during the closing action. As a result of this co-operation, the rotary latch acts on the carriage in such a way that the carriage is displaced into the locking position during the closing of the closing element by the force of the spring.

6 Claims, 6 Drawing Sheets

U.S. PATENT DOCUMENTS 5,401,067 A * 3/1995 Kurosaki et al. ..... 292/63
5,775,748 A 7/1998 Kurachi
5,997,056 A * 12/1999 Yamagishi ..... 292/341.17
7,201,409 B2 * 4/2007 Adachi et al. ..... 292/304
7,201,411 B2 * 4/2007 Bella et al. ..... 292/336.3
2009/0064735 A1 * 3/2009 Hartmann et al. ..... 70/158

* cited by examiner

CLOSING MECHANISM FOR A HOUSEHOLD APPLIANCE

CROSS REFERENCE TO RELATED APPLICATIONS

This application is a continuation of International Application No. PCT/EP2006/061579 having an international filing date of Apr. 13, 2006, which designated the United States, and claims the benefit under 35 USC §119(a)-(d) of German Application No. 10 2005 017 871.5, filed Apr. 19, 2005, the entireties of which are incorporated herein by reference.

FIELD OF THE INVENTION

The present invention relates to a closing mechanism for a household appliance.

BACKGROUND OF THE INVENTION

Household appliances such as dishwashers, washing machines, or refrigerators having a door, a cover or a flap that permits the loading and/or unloading of such an appliance and further assists the closing of the door, the cover or the flap by interaction with a closing mechanism.

A closing mechanism of the movable closing element on the household appliance, such as the door, the cover or the flap, can be mounted on the body of the household appliance. The closing mechanism has a closing hook which in turn can be engaged with the closing element during the closing action and/or disengaged therefrom during the opening action. A disadvantage with such a closing mechanism is the high closing force required to close the closing element.

SUMMARY OF THE INVENTION

The object of the invention is to develop the closing mechanism further in such a way that the closing force is reduced.

In the closing mechanism according to the invention, the closing hook is disposed on a carriage which can be moved between a locking and an unlocking position. The carriage is subjected to load by a spring force in the direction of the locking position. The closing mechanism also has a rotary latch which can be brought into interactive engagement with the closing element during the closing action. As a result of this interaction the rotary latch acts on the carriage in such a way that during the closing of the closing element the carriage is moved into the locking position by means of the force of the spring.

The carriage is beneficially disposed in a housing, so the closing mechanism constitutes a component suitable for pre-installation. The rotary latch is rotatably mounted in and/or on the housing, and in fact is mounted in such a way that the rotary latch projects out of the housing, at an opening for example, for the purpose of interacting with the closing element. Disposed in the housing is a guide into which the carriage engages by means of pegs to assist in its movement into the locking position, which increases the functional reliability of the closing mechanism accordingly.

The action of the rotary latch on the carriage can be effected in a simple manner by means of a lever. Located on the lever is a gate which interacts in turn with a lug on the carriage. By this means the lever moves the carriage in the guide during the closing action.

The spring is beneficially embodied as a tension spring. The spring is secured by its being appropriately hooked onto a mounting point on the carriage as well as to a suspension point in the housing. In this arrangement the spring preferably engages with the carriage in such a way that during the opening of the closing element a force acts on the carriage in the direction of the unlocking position with the result that the carriage then clicks into the unlocking position via the gate on the lever. This application of force can be achieved in a simple manner by means of an offset of the suspension point relative to the mounting point in the locking position.

The closing of the closing element is expediently effected by the engagement of the closing hook with a depression in the closing element. If the rotary latch has been actuated manually by mistake, without the closing element having been closed, the closing of the closing element can nonetheless be made possible by the following embodiment. For this purpose the closing hook is mounted in the carriage in a spring-loaded manner. Furthermore the closing hook has a contact bevel for the closing element. During the closing of the closing element, the closing hook is pressed into the carriage on account of the contact bevel and then slides once again into the depression of the closing element.

Finally, the closing mechanism can also be embodied with regard to an improvement of the child safety lock. Toward that end, a locking peg engages with the guide in the locking position, and in fact in such a way that the movement of the peg is blocked at the carriage. In the manner of a child safety lock, said locking peg can be disengaged from the guide for the purpose of opening the closing element by being released. For the purpose of manually actuating the locking peg, a lever that is accessible from outside the housing is in turn disposed on the closing mechanism.

The advantages achieved by means of the invention are in particular that the closing mechanism is functionally reliable and provides an improved installation capability. Furthermore, notwithstanding its high level of functionality the closing mechanism is inexpensive and so suitable in particular for cost-sensitive household appliances.

BRIEF DESCRIPTION OF THE DRAWINGS

An exemplary embodiment of the invention with various developments and refinements is illustrated in the drawings and is described in more detail below.

DETAILED DESCRIPTION OF THE INVENTION

Figure 1:
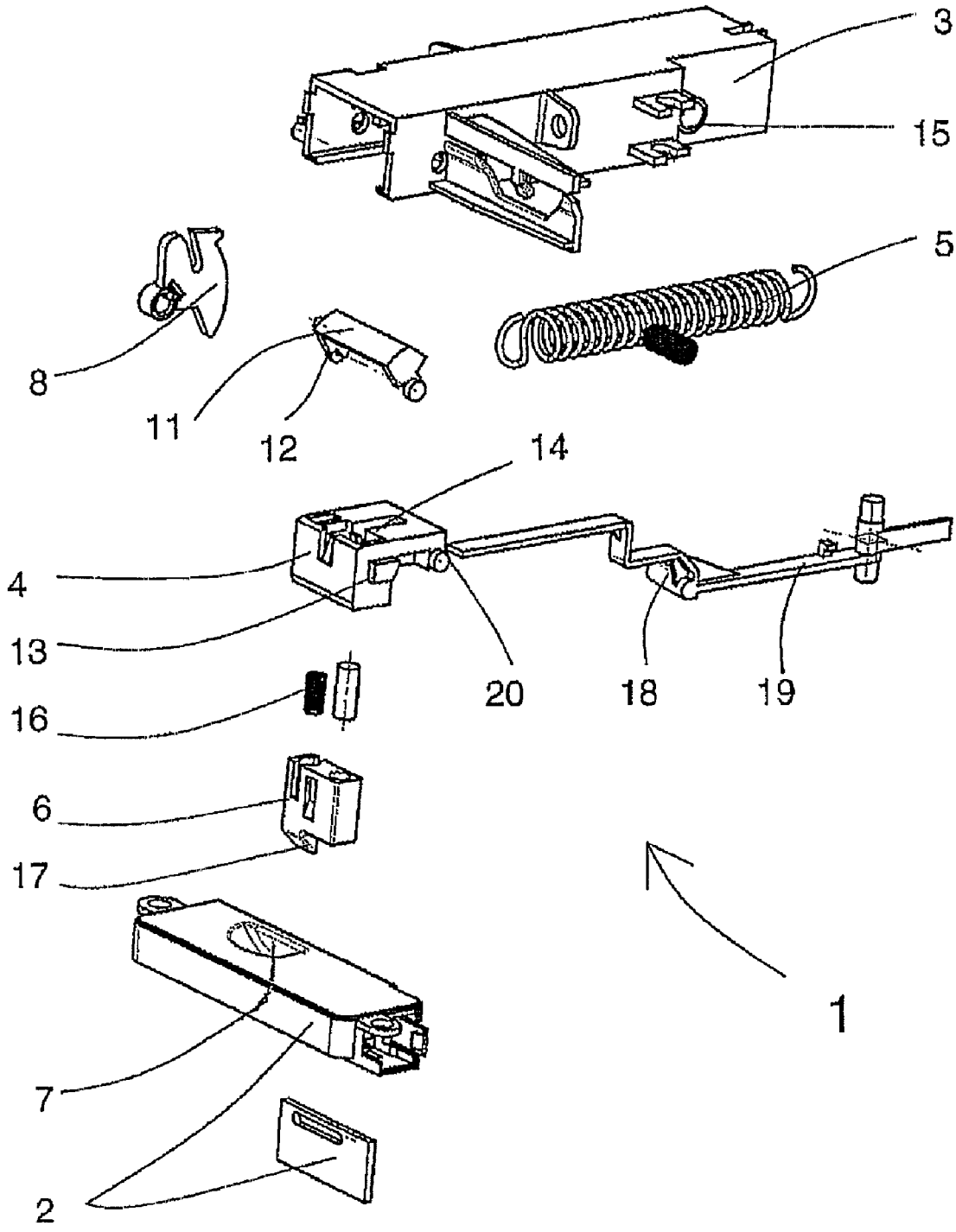
FIG. 1 shows a closing mechanism in an exploded view.
Figure 2:
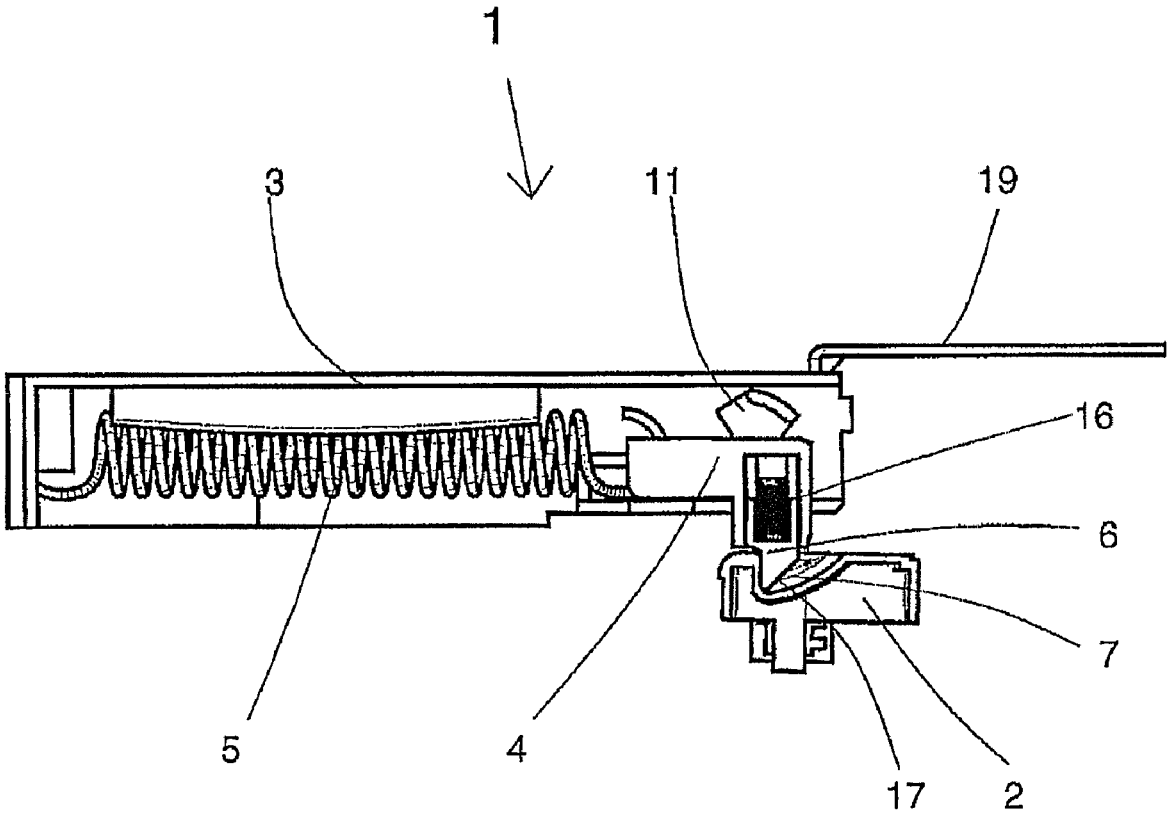
FIG. 2 shows the closing mechanism from FIG. 1 in locking engagement with the closing element.

FIG. 1 shows a closing mechanism 1 for a movable closing element 2 according to its individual parts. The closing element 2, which is merely indicated schematically, is a door, a cover, a flap or the like on a household appliance, such as on a dishwasher, a washing machine, a refrigerator or the like, wherein the closing element 2 is movably secured in a known manner by means of a hinge on the body of the household appliance. The closing mechanism 1 has a housing 3 in which is disposed a carriage 4 which can be moved between a locking and an unlocking position. The locking position can be seen in more detail in FIG. 5 and FIG. 6, and the unlocking position in FIG. 7 and FIG. 8. The carriage 4 is subjected to load in the direction of the locking position by means of a spring 5. Disposed on the carriage 4 is a closing hook 6 which can be brought into engagement with the closing element 2 when said closing element 2 is closed, as can be seen with reference to FIG. 2. For this purpose the closing hook 6 can be brought into locking engagement with a depression 7 in the closing element 2. When the closing element 2 is opened, the closing hook 6 is released from engagement with the closing element 2 by leaving the depression 7, though this is not depicted in more detail in the drawings.

Figure 3:
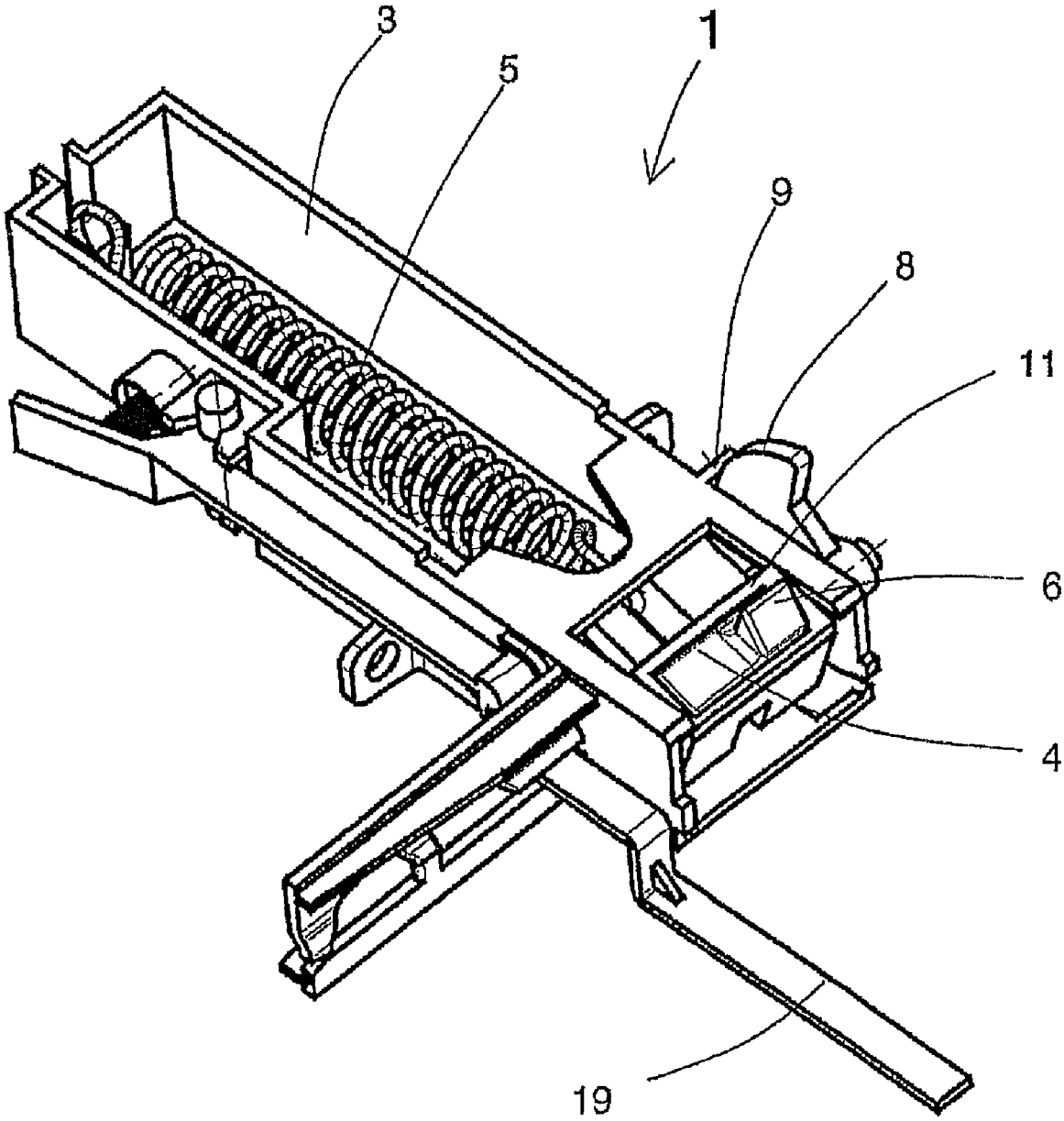
FIG. 3 shows the closing mechanism in a perspective view, seen from one side.
Figure 4:
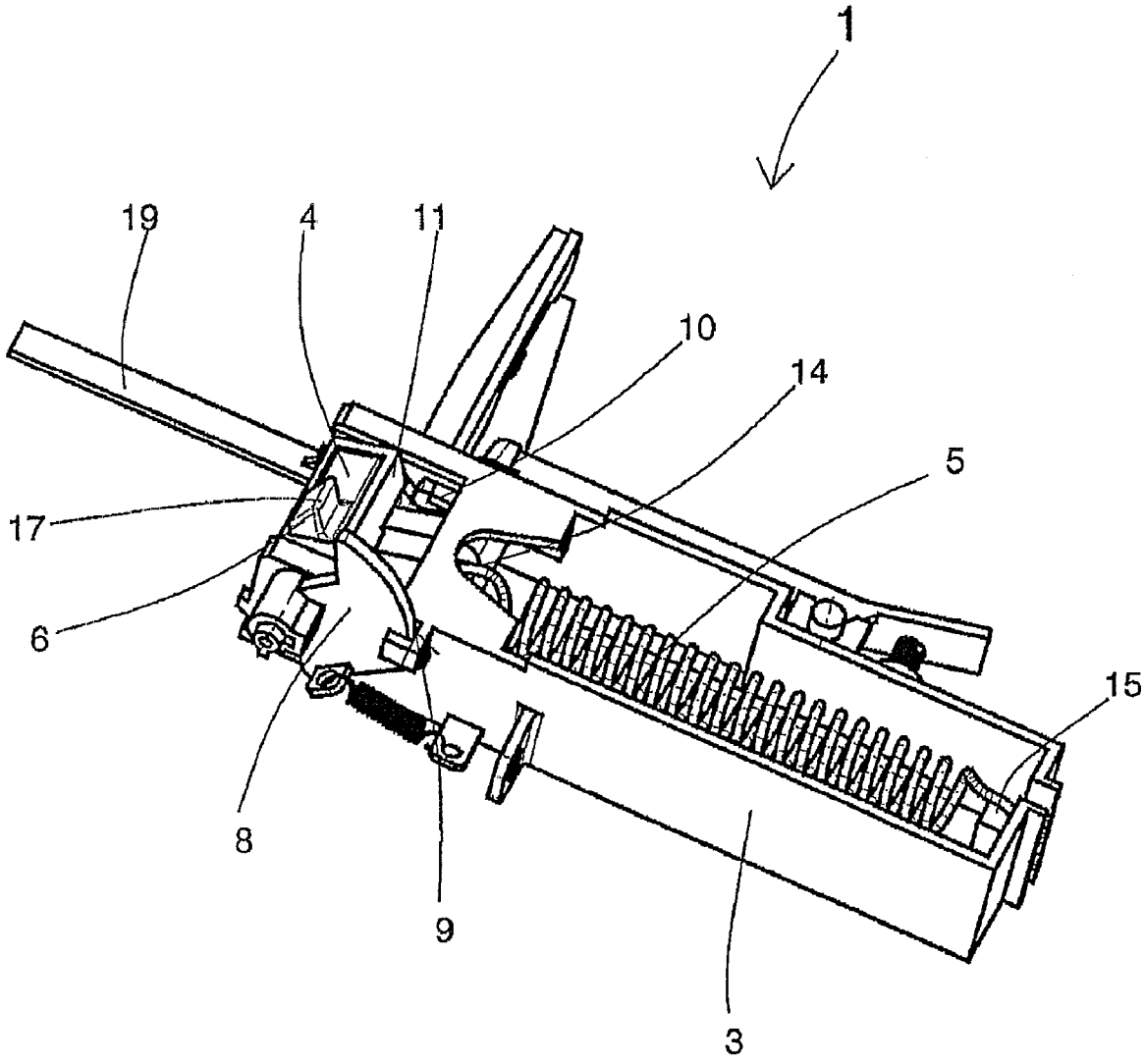
FIG. 4 shows the closing mechanism as in FIG. 3, seen from the other side.

As can also be seen from FIG. 1, a rotary latch 8 is rotatably mounted in and/or on the housing 3. The rotary latch 8 can be brought into interactive engagement with the closing element 2 during the closing of the closing element 2. As a result of said interaction, the rotary latch 8 then acts on the carriage 4 in such a way that during the closing of the closing element 2 the carriage 4 is moved into the locking position shown in FIG. 5 by the force of the spring 5. In order to interact with the closing element 2, the rotary latch 8 disposed at the side of the housing 3 projects from the housing 3, for example at a kind of opening 9, or stands proud of the housing 3, as can be seen in FIG. 3 and FIG. 4.

Figure 5:
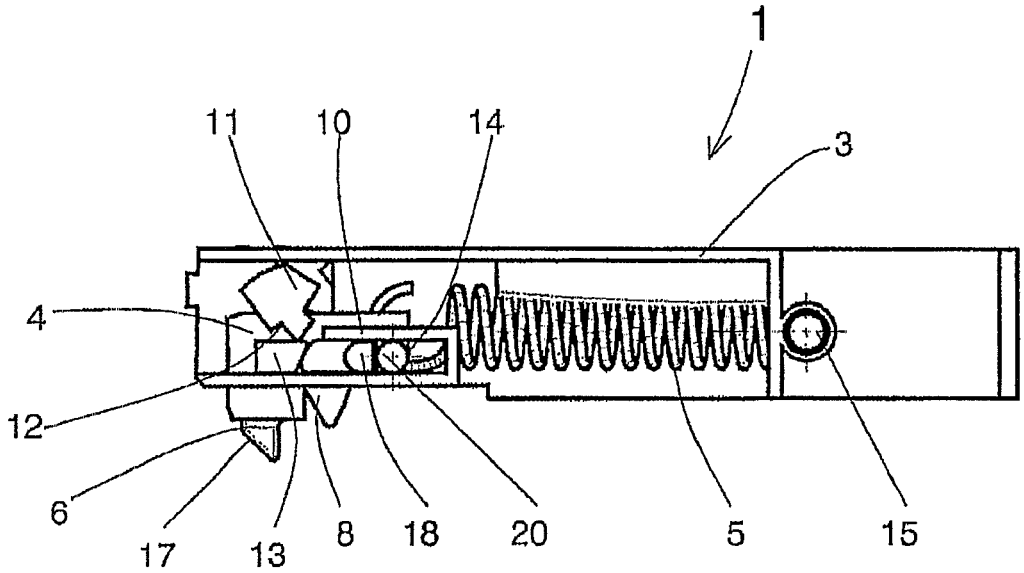
FIG. 5 shows a section through the closing mechanism, with the carriage located in the locking position.
Figure 6:
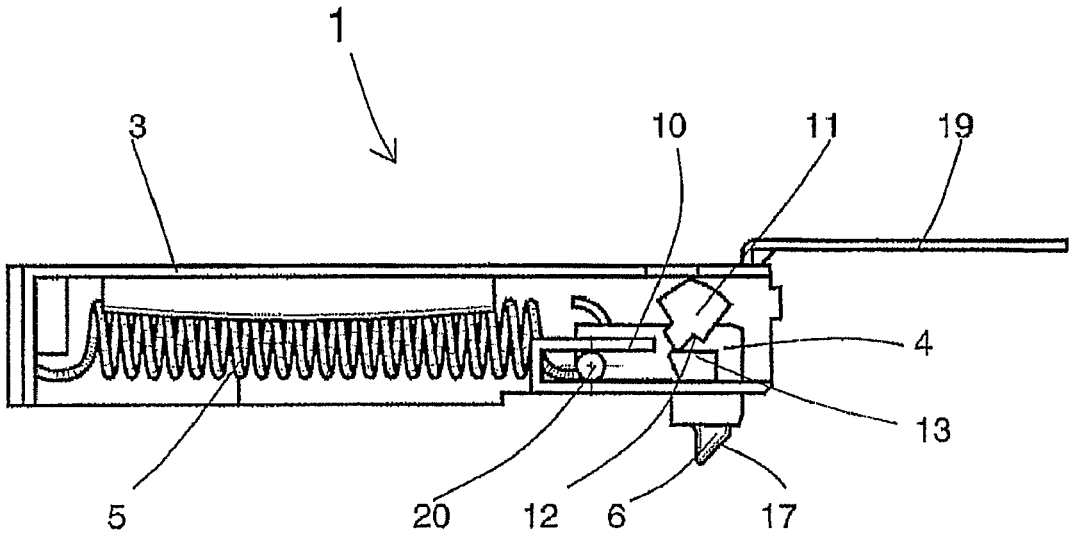
FIG. 6 shows a section as in FIG. 5, but seen from the opposite side.
Figure 7:
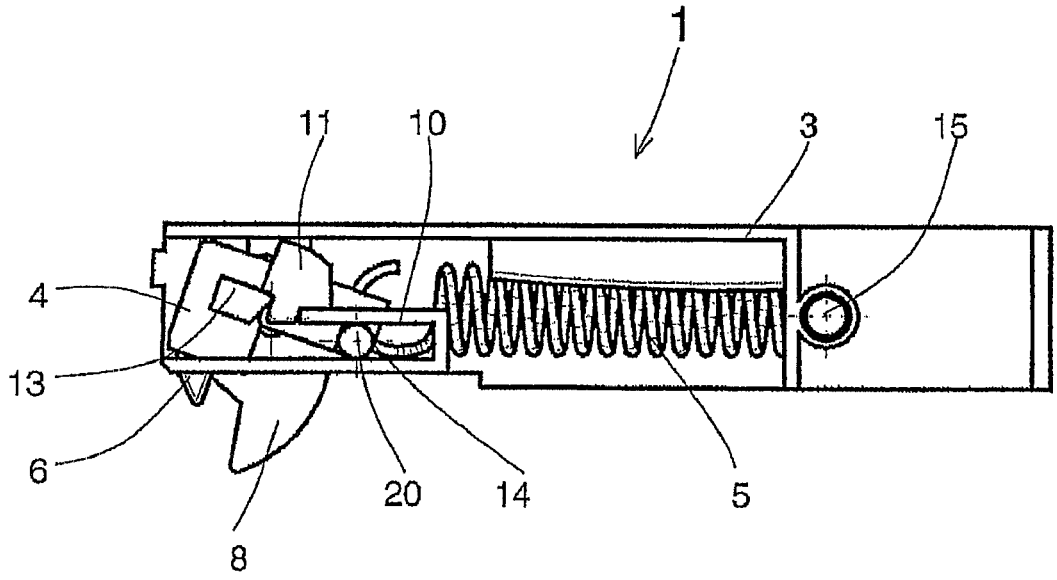
FIG. 7 shows a section through the closing mechanism, with the carriage located in the unlocking position.
Figure 8:
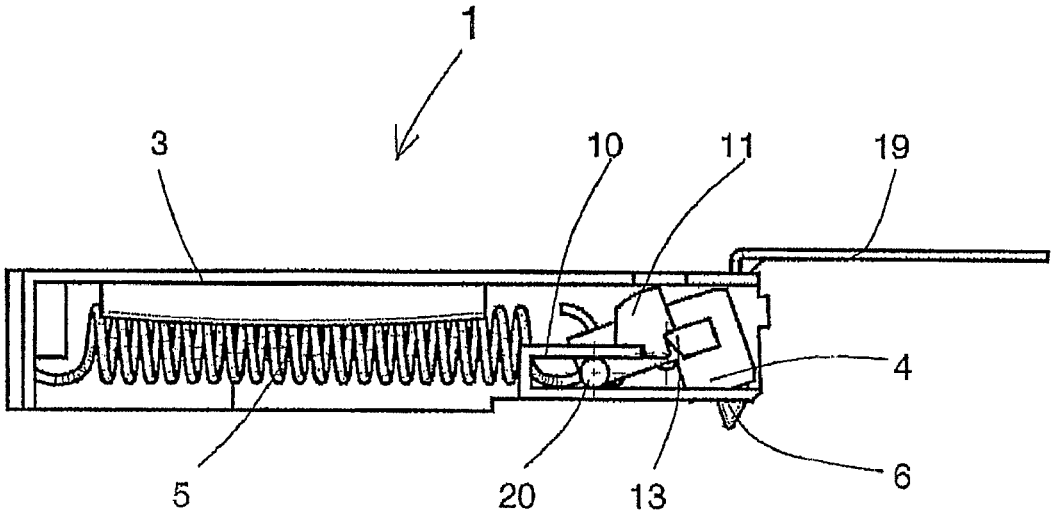
FIG. 8 shows a section as in FIG. 7, but seen from the opposite side.

As can be seen with reference to FIG. 5 or FIG. 7, a guide 10 for the carriage 4 to assist its movement into the locking position is disposed in the housing 3. The rotary latch 8 acts on the carriage 4 via a lever 11, for which purpose a gate 12 is located on the lever 11. The gate 12 on the lever 11 in turn interacts with a lug 13 on the carriage 4, and specifically in such a way that during the closing of the closing element 2 the lever 11 moves the carriage 4 in the guide 10 by means of pegs 20.

The spring 5 is embodied as a tension spring and is secured by hooking action to a mounting point 14 on the carriage 4 as well as to a suspension point 15 in the housing 3. There is also an offset of the suspension point 15 relative to the mounting point 14 in the locking position, as can be seen with reference to FIG. 5, such that the spring 5 engages with the carriage 4 in such a way that when the closing element 2 is opened, a force acts on the carriage 4 in the direction of the unlocking position. The closing hook 6 is mounted in a spring-loaded mariner in the carriage 4 by means of a compression spring 16, as can be seen in FIG. 1. The closing hook 6 also has a contact bevel 17, visible in FIG. 5, for the closing element 2 in order to allow a kind of self-healing effect which is explained in more detail below. In the locking position, finally, a locking peg 18 is engaged with the guide 10, as a result of which the movement of the locking peg 18 on the carriage 4 is blocked. The locking peg 18 can be disengaged from the guide 10 in the manner of a child safety lock for the purpose of opening the closing element 2 by releasing. A lever 19 which is accessible from outside the housing 3 is disposed on the housing 3 to allow manual actuation of the locking peg 18.

The mode of operation of the closing mechanism 1 with second-operation path will now be explained in more detail below, the closing element 2 being referred to for simplicity as the door and the household appliance being designated by dishwasher.

The closing mechanism 1 independently keeps the door 2 of the dishwasher closed by means of a closing force. It is possible to open the door 2 at any time by overcoming this force.

When the door 2 is closed, it actuates the rotary latch 8. The rotary latch 8 causes the carriage 4 to be moved downward with the closing hook 6 via the lever 11 with gate 12 until the carriage 4 can slide backward in its guide 10, pulled by the tension of spring 5. During the downward movement the closing hook 6 dips into a depression 7 of the door 2 and pulls it along with it. The tension spring force pulls the door 2 against the rubber seal until there is an equalization of forces. This closing operation is also illustrated in more detail with reference to FIG. 7.

During opening, the closing hook 6 takes the carriage 4 along with it until the carriage 4 can snap upward via the gate 12 of the lever 11. The door 2 is released. The rotary latch 8 is again rotated by the lever 11 into the starting position. This opening operation is also clarified more closely with reference to FIG. 5.

A kind of self-healing effect is provided as a supplementary function. It can happen that the rotary latch 8 is released inadvertently by hand, without engagement of the door 2. The closing mechanism 1 is in the closed position and the door 2 is still open. For this eventuality the closing hook 6 is mounted in a spring-loaded manner in the carriage 4 and possesses a contact bevel 17 on the outside. The door 2 can thus be closed with the closing mechanism 1 closed. In the process the spring-loaded closing hook 6 is pressed into the carriage 4 and then slides into the depression 7 of the door 2 again as soon as the latter has been completely closed. After the door 2 is opened, the closing mechanism 1 is once again in the right position.

A child safety lock to prevent unintended opening by children is appropriate as a further optional supplementary function. In order to open the door 2, the locking peg 18, which prevents the upward movement of the carriage 4, must be released by way of the lever 19 which is accessible from outside. The opening path of the door 3 for the purpose of ventilation in the event of excessive steam pressure is ensured. The child safety lock can be switched on and off. Even with the child safety lock activated, the door 2 can still be opened by means of an increased application of force, for example from inside with pressure on the door 2.

The optimized solution according to the invention achieves the following advantages. The closing force is reduced as a result of relocation of the tension spring mounting point in the carriage 4. In the invention the lever 11 is integrated with the gate 12 in the housing 3. A separate lever and therefore also the installation of same are dispensed with. The rotary latch 8 now moves the carriage 4 downward directly via the lug 13. A spring is necessary in order to provide autonomous resetting of the rotary latch 8. To allow improved installation of the child safety lock, the leg spring is replaced by a compression spring. A displacement of the pivotal point is necessary in order to increase the holding force.

The invention is not limited to the described and illustrated exemplary embodiment. Rather, it also includes all competent developments within the scope of the invention defined by the patent claims. Thus, conversely, the closing mechanism 1 can also be disposed on the movable closing element 2, with the closing hook 6 then engaging in the body on the household appliance. Furthermore, a closing mechanism 1 of this kind can be used not only in household appliances, but also in motor vehicles, real estate applications or the like.

LIST OF REFERENCE CHARACTERS

1: Closing mechanism
2: Closing element/door
3: Housing

4: Carriage
5: Spring/tension spring
6: Closing hook
7: Depression
8: Rotary latch
9: Opening
10: Guide
11: Lever
12: Gate (on the lever)
13: Lug (on the carriage)
14: Mounting point (for spring, on the carriage)
15: Suspension point (for spring, on the housing)
16: Compression spring (for closing hook)
17: Contact bevel
18: Locking peg
19: Lever (for actuating locking peg)
20: Peg (on the carriage)

We claim:

1. A closing mechanism for a movable closing element, in particular for a door, a cover or a flap on a household appliance comprising a housing, a carriage disposed in the housing and being movable between a locking and an unlocking position, a guide in the housing to assist movement of the carriage into the locking position, a spring for subjecting the carriage to a load in the direction of the locking position, a closing hook disposed on the carriage, wherein during the closing action the closing hook is brought into engagement with the closing element and during the opening action the closing hook is released from engagement with the closing element, and a rotary latch mounted in a rotatable manner relative to the housing such that the rotary latch projects from the housing at an opening for interacting with the closing element, wherein during the closing action the rotary latch is brought into interactive engagement with the closing element, wherein as a result of said interaction the rotary latch acts on the carriage such that during the closing of the closing element the carriage is moved into the locking position due to the force of the spring.

2. The closing mechanism as claimed in claim 1, wherein the closing hook is brought into engagement with a depression in the closing element.

3. The closing mechanism as claimed in claim 1, wherein the spring is a tension spring secured at a mounting point on the carriage and at a suspension point in the housing, and the spring also engages with the carriage by displacement of the suspension point relative to the mounting point in the locking position, such that during the opening of the closing element a force acts on the carriage in the direction of the unlocking position.

4. The closing mechanism as claimed in claim 1, wherein the closing hook is mounted in a spring-loaded manner in the carriage, and the closing hook has a contact bevel for interaction with the closing element.

5. A closing mechanism for a movable closing element, in particular for a door, a cover or a flap on a household appliance, comprising a housing, a carriage disposed in the housing and being movable between a locking and an unlocking position, a guide in the housing to assist movement of the carriage into the locking position, a spring for subjecting the carriage to a load in the direction of the locking position, a closing hook disposed on the carriage, wherein during the closing action the closing hook is brought into engagement with the closing element and during the opening action the closing hook is released from engagement with the closing element, and a rotary latch that acts on the carriage via a lever having a die gate thereon that interacts with a lug on the carriage such that during the closing of the lever the carriage moves in the guide by means of pegs, wherein during the closing action the rotary latch is brought into interactive engagement with the closing element, wherein as a result of said interaction the rotary latch acts on the carriage such that during the closing of the closing element the carriage is moved into the locking position due to the force of the spring.

6. A closing mechanism for a movable closing element, in particular for a door, a cover or a flap on a household appliance comprising a housing, a carriage disposed in the housing and being movable between a locking and an unlocking position, a guide in the housing to assist movement of the carriage into the locking position, a spring for subjecting the carriage to a load in the direction of the locking position, a closing hook disposed on the carriage, wherein during the closing action the closing hook is brought into engagement with the closing element and during the opening action the closing hook is released from engagement with the closing element, and a rotary latch, wherein during the closing action the rotary latch is brought into interactive engagement with the closing element, wherein as a result of said interaction the rotary latch acts on the carriage such that during the closing of the closing element the carriage is moved into the locking position due to the force of the spring, wherein in the locking position a locking peg blocking a peg on the carriage is in engagement with the guide, and the locking peg is released from engagement with the guide in the manner of a child safety lock for the purpose of opening the closing element, and a lever which is accessible from outside the housing is disposed for the purpose of manual actuation of the locking peg.

* * * * *